United States Patent [19]

Chu

[11] Patent Number: 4,509,865

[45] Date of Patent: Apr. 9, 1985

[54] ELECTROMAGNETICALLY-INDUCED ROCKING CLOCK

[76] Inventor: Kuo-Chin Chu, 10-4 Fl., No. 62, Chang Chun Rd., Taipei, Taiwan

[21] Appl. No.: 602,111

[22] Filed: Apr. 20, 1984

Related U.S. Application Data

[63] Continuation-in-part of Ser. No. 554,281, Nov. 22, 1983.

[51] Int. Cl.[3] ..... G04B 15/00

[52] U.S. Cl. ..... 368/134; 368/179

[58] Field of Search ..... 368/179, 134, 223, 276, 368/327

[56] References Cited

U.S. PATENT DOCUMENTS 4,395,137 7/1983 Wiley ..... 368/179

FOREIGN PATENT DOCUMENTS 56-49972 5/1981 Japan ..... 368/179

2017982 10/1979 United Kingdom ..... 368/179

*Primary Examiner*—Bernard Roskoski

[57] ABSTRACT

An electromagnetically-induced rocking clock includes a pendulum-adjustment means having an adjustable weight pivotedly formed on a casing movably fixed on a pendulum so that the weight can be moved either rightward or leftward and the casing can be vertically moved up and down to adjust the gravity center of the pendulum to obtain the selective swinging angle, speed or amplitude of the pendulum.

2 Claims, 4 Drawing Figures

ELECTROMAGNETICALLY-INDUCED ROCKING CLOCK

BACKGROUND OF THE INVENTION

This application is a continuation-in-part of original application of Ser. No. 554,281 filed on Nov. 22, 1983. Original application disclosed an electromagnetically-induced rocking clock having two supporting needles of the rocking clock body pivotedly mounted on two abrasion-resistant sockets, which may have wider swinging angle for the clock body or pendulum and have reduced abrasion between the needles and the sockets. However, the gravity center of its pendulum is fixed and the arm of force of such pendulum is fixed so that the swinging angle and speed of the pendulum will not be adjusted. Meanwhile, the original application is lacking of adjustment means to maintain a sharply vertical pendant for the pendulum, so the oscillation of pendulum either rightward or leftward will not be symmetrical.

The present inventor has found the defects of original application and invented the present improved rocking clock.

SUMMARY OF THE INVENTION

The object of the present invention is to provide an improved electromagnetically-induced rocking clock including a pendulum-adjustment means which is adjustably fixed on a pendulum to adjust the position of its gravity center so as to select the desired swinging angle and velocity of the rocking clock.

Another object of the present invention is to provide an impact-prevention means between a fixed clock body and a swinging casing of a pendulum wherein a pair of permanent magnets are formed on the outer perimeter of central clock body and another pair of permanent magnets are correspondingly formed on the inner perimeter of outer swinging casing so that when outer swinging casing approaches inner clock body during rocking motion, the magnetic repulsive force exerting therebetween may buffer the outer casing and prevent from impact between outer casing and inner clock.

DETAILED DESCRIPTION

Figure 1:
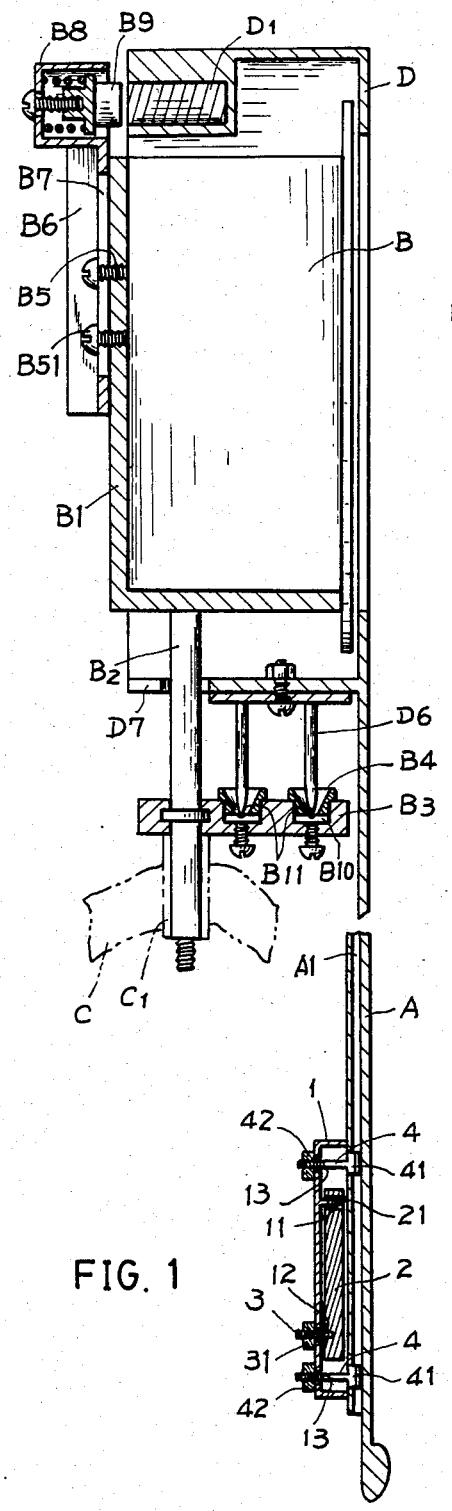
FIG. 1 is a side-view sectional drawing of the present invention.

As shown in FIG. 1, an electromagnetically-induced rocking clock of the original application includes a pendulum A fixed on a casing D, a quartz clock B fixed on a L-shape supporting rack B1 fixed into a sleeve C1 of a decorative figurine C by supporting rod B2, and a swinging casing D with two supporting needles D6 pivotedly mounted on two abrasion-resistant sockets B11 formed on a horizontal rod B3 fixed on supporting rod B2. The abrasion-resistant socket B11 is terminated by a steel or jewel-like plate B10. The lower casing of swinging casing D is formed with an opening D7 to prevent from being obstructed by rod B2 during rocking motion. The L-shaped supporting rack B1 is formed with several positioning screw holes B5. A vertical rod

B6 is formed with a positioning hole B7 to allow a fixing screw B51 passing through hole B7 and fixed into screw hole B5. A casing B8 provided with a permanent magnet B9 is formed atop on vertical rod B6. An induction coil D1 is formed on swinging casing D to correspond magnet B9.

The pendulum-adjustment means of the present invention includes a casing 1 adjustably formed on pendulum A, an adjustable weight 2 pivotedly fixed on casing 1, a transversely adjusting screw 3 definitely fixing adjustable weight 2 on casing 1 and two longitudinally adjusting screws 4 adjustably fixing casing 1 along a groove A1 formed on pendulum A.

Casing 1 is formed with a pin 11 to pivotedly mount adjustable weight 2 through a hole 21 formed on weight 2. An arcuated hole 12 is transversely formed on casing 1. Transversely adjusting screw 3 is passing through hole 12 on casing 1 and is fastened by nut 31 to definitely fix weight 2 on specific point on casing 1. Casing 1 is formed with an upper and a lower hole 13 to insert two fixing screws 4 respectively through holes 13 and then fix screws 4 on casing 1 by nuts 42. Each screw 4 is formed with an extension 41 which is engaged with a vertical lengthy groove A1 formed on pendulum A so that casing 1 can be vertically moved along groove A1 and then fixed thereon by such screws 4.

When using the pendulum-adjustment means of the present invention, the pendulum A is kept naturally vertical by releasing any magnetic repulsive force between magnet B9 and coil D1 and if the pendulum A is not sharply vertical, the weight 2 can be transversely adjusted by moving screw 3 either rightward or leftward and then fixing it. Accordingly, the pendulum A is then really vertical and the swinging casing D, after being actuated by magnet B9 and coil D1, will get a symmetrical swinging motion either rightward or leftward. In order to adjust the swinging amplitude, speed or angle of pendulum A, the casing 1 may be longitudinally adjusted either upwards or downwards to obtain the desired value or status for the pendulum A and casing D.

Figure 3:
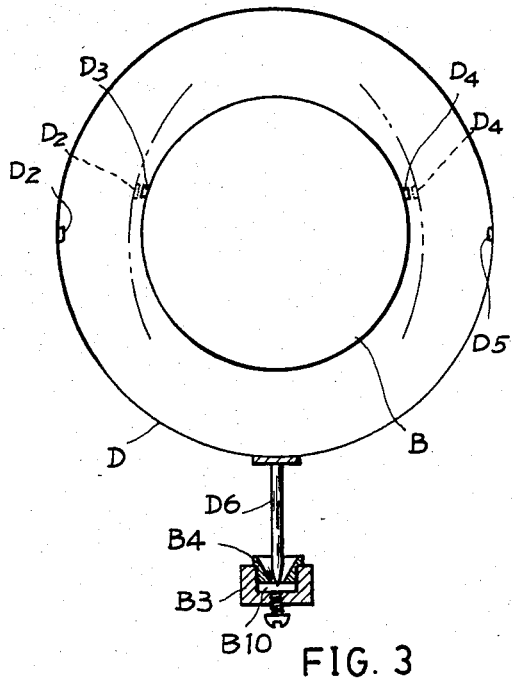
FIG. 3 is a partial rear view of the impact-prevention means of the present invention.
Figure 2:
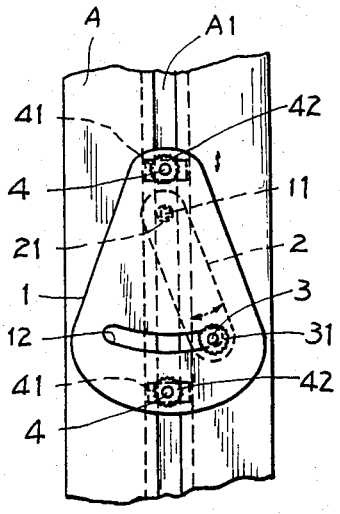
FIG. 2 is a partial rear view of pendulum-adjustment means of the present invention.
Figure 4:
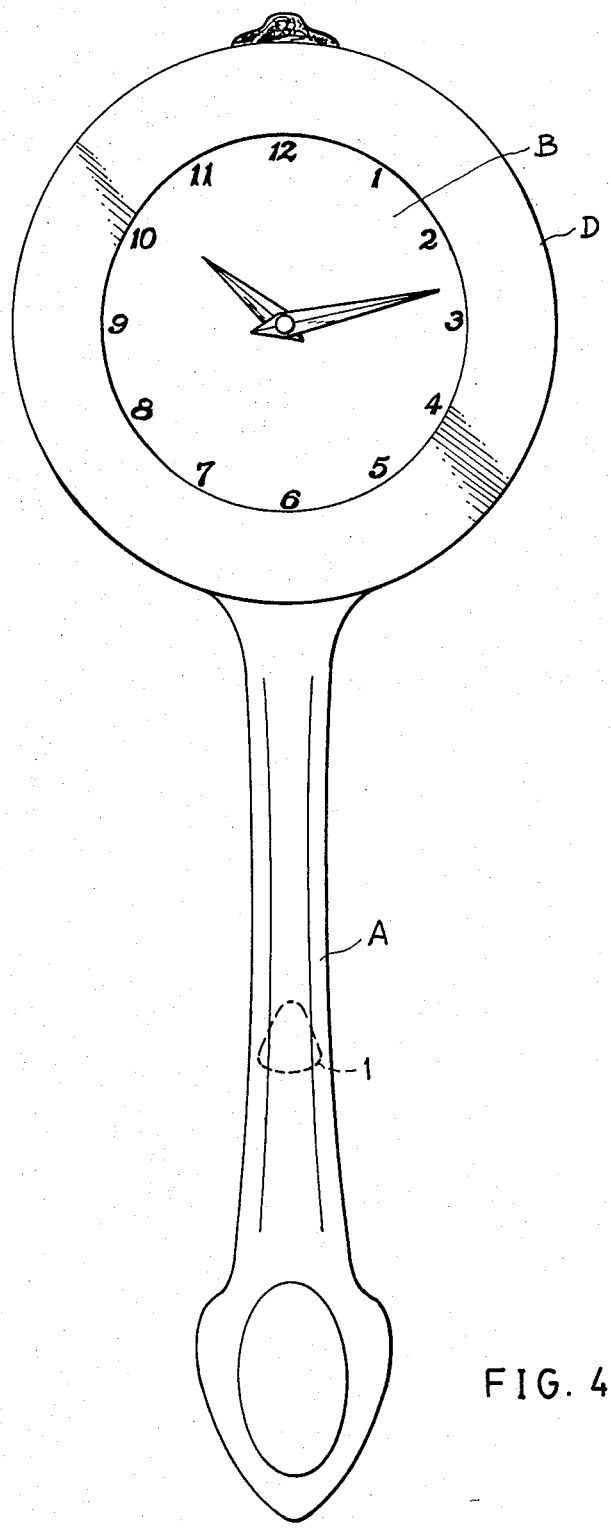
FIG. 4 is a front elevation of the present invention.

The impact-prevention means of the present invention is shown in FIG. 3 which comprises a pair of permanent magnets D2,D5 being formed on the inner perimeter of outer swinging casing D and a pair of permanent magnet D3, D4 being correspondingly formed on the outer perimeter of inner clock B. The position of magnet D3 or D4 should be located approaching to the utmost swinging point of magnet D2 or D5 respectively. The facing ends of both magnet D2 and D3 should be the same in magnetic poles to produce repulsive force whenever facing each other.

The poles of magnets D4 and D5 should also be same when facing each other. By the way, the swinging casing D will never impact clock B to protect the clock. The numbers of magnets are not limited in this invention.

The present invention has the following advantages:

1. The pendulum can be adjusted for its gravity center either transversely or longitudinally so as to diversify the swinging angle, speed or amplitude of the pendulum or to increase the oscillation symmetry of the pendulum.

2. The swinging casing will never impact the inner clock for safer protection of the clock to enhance its service life.

I claim:

1. An electromagnetically-induced rocking clock having a pendulum-adjustment means which comprises:

a casing adjustably fixed on said pendulum and being formed with an arcuated hole thereon;

an adjustable weight pivotedly fixed on said casing;

a transversely adjusting screw passing through said arcuated hole formed on said casing and being fastened by nut 31 to definitely fix said weight on a specific point on said casing so that said screw and said weight can be moved either rightward or leftward to obtain a sharply vertical pendulum; and two longitudinally adjusting screws, formed on said casing, each adjusting screw being formed with an extension engaged with a vertical lengthy groove formed on said pendulum so that said casing may be vertically adjustably fixed on said pendulum by fixing a nut on each said longitudinally adjusting screw so as to adjust the gravity center and the arm of force of said pendulum.

2. An electromagnetically-induced rocking clock having an impact-prevention means which comprises:

a pair of permanent magnets formed on the inner perimeter of outer swinging casing and a pair of permanent magnets corresponding formed on the outer perimeter of inner clock, each permanent magnet formed on inner clock being located approaching to utmost swinging point of each said permanent magnet formed on outer swinging casing and the magnetic pole of said magnet formed on the inner clock being the same as that of said magnet formed on the outer casing for producing repulsive force whenever facing each other so as to prevent collision therebetween.

* * * * *